US007537482B2

(12) United States Patent
Burris et al.

(10) Patent No.: US 7,537,482 B2
(45) Date of Patent: May 26, 2009

(54) COAXIAL CABLE CONNECTOR

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/895,311

(22) Filed: Aug. 24, 2007

(65) Prior Publication Data

US 2009/0053929 A1 Feb. 26, 2009

(51) Int. Cl.
*H01R 9/05* (2006.01)

(52) U.S. Cl. ..... 439/578

(58) Field of Classification Search ..... 439/578, 439/580, 583–585
See application file for complete search history.

(56) References Cited

U.S. PATENT DOCUMENTS

| | | | | |
|---|---|---|---|---|
| 3,977,752 | A | 8/1976 | Freitag | 339/95 A |
| 4,289,368 | A | 9/1981 | Schildkraut | 339/89 M |
| 4,342,496 | A | 8/1982 | Hutter et al. | 339/177 E |
| 4,596,435 | A | 6/1986 | Bickford | 339/177 R |
| 4,676,577 | A | 6/1987 | Szegda | 439/584 |
| 4,854,893 | A | 8/1989 | Morris | 439/578 |
| 5,011,432 | A | 4/1991 | Sucht et al. | 439/584 |
| 5,860,833 | A | 1/1999 | Chillscyzn et al. | 439/585 |
| 6,089,903 | A | 7/2000 | Stafford Gray et al. | 439/439 |
| 6,089,913 | A | 7/2000 | Holliday | 439/584 |
| 6,102,738 | A | 8/2000 | Macek et al. | 439/584 |
| 6,159,046 | A | 12/2000 | Wong | 439/578 |
| 6,179,656 | B1 | 1/2001 | Wong | 439/578 |
| 6,293,004 | B1 | 9/2001 | Holliday | 29/751 |
| 6,352,448 | B1 | 3/2002 | Holliday et al. | 439/585 |
| 6,884,113 | B1 | 4/2005 | Montena | 439/578 |
| 7,029,323 | B1 * | 4/2006 | Petersen et al. | 439/578 |
| 7,153,159 | B2 | 12/2006 | Burris et al. | 439/578 |

(Continued)

FOREIGN PATENT DOCUMENTS

EP 0768736 A2 4/1997

OTHER PUBLICATIONS

Corning Gilbert Inc., UltraSeal Series; "F" Series 7 and 11 Connectors Product Information, Oct. 2002.

(Continued)

*Primary Examiner*—Ross N Gushi
(74) *Attorney, Agent, or Firm*—Joseph M. Homa; Matthew J. Mason

(57) ABSTRACT

A coaxial cable connector having a front end for attachment to a terminal and a back end for attachment to a coaxial cable includes a body, a post mounted within the body; and a contact assembly movably mounted within the post. The contact assembly includes a guide, a contact mounted to the guide, and an insulator partially surrounding the contact. The contact assembly moves longitudinally toward the front end of the connector, such that the front end of the contact moves from a first position within the body to a second position proximate the connector interface, as the connector receives the coaxial cable. The guide has an opening for the center conductor, which is viewable to a user during attachment until the center conductor enters the opening. An adapter is also provided that can be shipped with connector for use in securing the coaxial cable connector on a coaxial cable.

13 Claims, 15 Drawing Sheets

U.S. PATENT DOCUMENTS

| | | | | |
|---|---|---|---|---|
| 2004/0110418 | A1 | 6/2004 | Holliday et al. | 439/585 |
| 2005/0272296 | A1 | 12/2005 | Laverick | 439/353 |
| 2005/0277330 | A1 | 12/2005 | Kisling et al. | 439/578 |
| 2006/0160416 | A1 * | 7/2006 | Burris et al. | 439/578 |

OTHER PUBLICATIONS

Corning Gilbert Inc., NS-7141-1, mechanical drawing of connector sold by Corning Gilbert Inc. before Jan. 2004.

Corning Gilbert Inc., Installation Instructions for GA-BNC-US-59-HEC, on or before Apr. 2003.

Corning Gilbert Inc., UntraSeal Series; UltraSeal headend BNC Connector Product Information (GA-BNC-US-59-HEC), published Apr. 2003.

* cited by examiner

FIGURE 3A
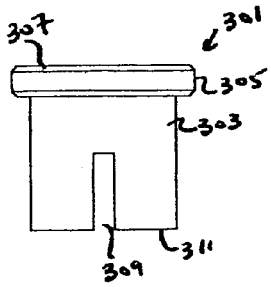
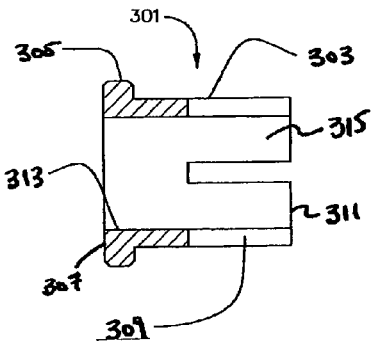
FIGURE 3B
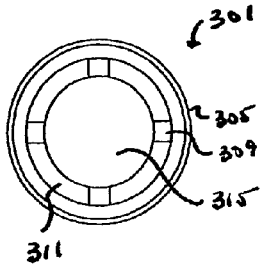
FIGURE 3C
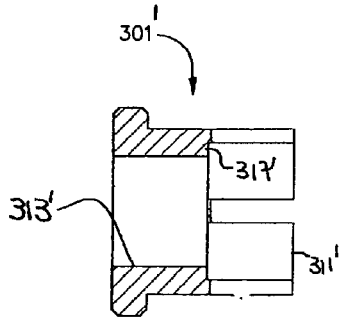
FIGURE 3D
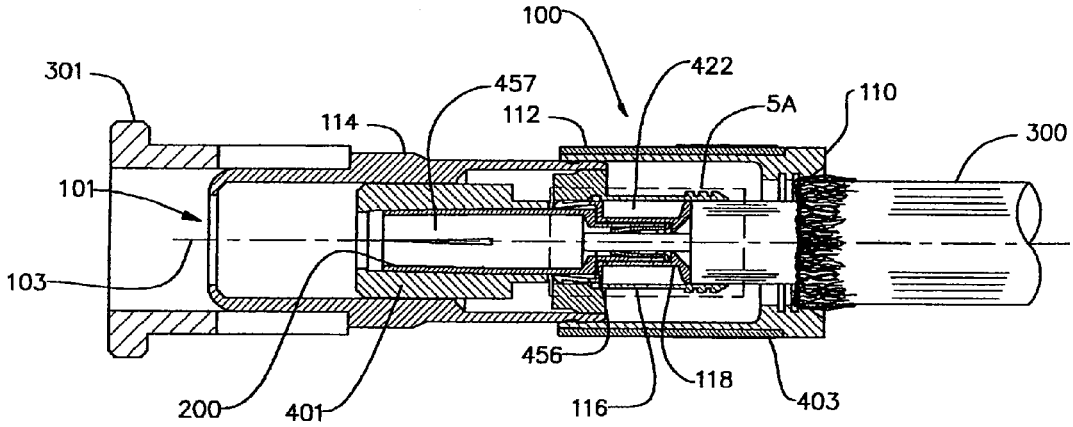
FIGURE 4

COAXIAL CABLE CONNECTOR

BACKGROUND

The present invention relates generally to coaxial cable connectors and more particularly to coaxial cable connectors having a female configuration at an end opposite the connection point for a coaxial cable, and an optional adapter therefor.

Coaxial cable connectors, such as axially-compressible RCA, BNC, and F connectors, are used to attach a coaxial cable to another object, such as an appliance or junction, having a terminal adapted to engage the coaxial cable connector. After an end of the coaxial cable is trimmed using one of several known cable preparation techniques, the trimmed end of the coaxial cable is inserted into a back end of the connector. Then, the coaxial cable connector is axially compressed using one of several known installation tools, and the coaxial cable connector and the coaxial cable become permanently attached to each other.

Disadvantageously, many known connectors require "blind entry" of the coaxial cable into the connector, meaning that a small opening in the coaxial cable connector into which it is necessary to insert the center conductor of the coaxial cable becomes blocked from a user's view by a dielectric component or the jacket of the coaxial cable. The dielectric component or jacket blocks the user's view of the small opening primarily because the small opening is recessed too deeply in the coaxial cable connector. Such known coaxial cable connectors often make it difficult to ensure that the dielectric component, or foam core, of the coaxial cable is properly centered within the coaxial cable connector during insertion of the coaxial cable into the coaxial cable connector.

Many known connectors utilize separate or loose components that must be manipulated during installation, and, therefore, are subject to loss or damage. For example, a known RCA connector is supplied with a loose contact, meaning that the contact is not integral with the body of the connector when shipped and is easily lost or misplaced. Additionally, such a coaxial cable connector is more cumbersome and expensive since extra manipulation is required to install the separate component.

Therefore, a coaxial cable connector is needed that obviates these issues and provides a connector that is easy to install and allows the user a view for inserting the coaxial cable.

SUMMARY

Disclosed herein is a coaxial cable connector for attachment to a coaxial cable, the coaxial cable having a center conductor, a dielectric layer surrounding the center conductor, and an outer conductor surrounding the dielectric layer, the coaxial cable connector including a body having a front end, a back end, a longitudinal opening extending between the front end and the back end along a longitudinal axis, a post fixedly mounted within the body; and a contact assembly movably mounted to the post and capable of moving longitudinally relative to the body, the contact assembly further including a guide having an opening therein to receive the center conductor of the coaxial cable, a contact element having a fixed relationship to the guide and having a front end, a back end, and an opening extending between the front end and the back end to receive an electrical contact through the front end of the body, and an insulator disposed around at least a portion of the contact element, wherein the contact assembly is capable of moving along the longitudinal axis toward the front end of the coaxial cable connector in response to insertion of the coaxial cable into the back end of the coaxial cable connector, wherein the front end of the contact element is disposed adjacent the front end of the body when the coaxial cable is fully inserted into the back end of the coaxial cable connector.

In other embodiments, the dielectric layer of the coaxial cable causes the contact assembly to move relative to the body.

In some embodiments, the post has a circumferential groove in an inside surface of the post and the guide has a least one projection configured to engage the circumferential groove in a first position.

In other embodiments, the coaxial cable connector includes a compression ring having an inside surface defining a longitudinal opening, the compression ring movable over at least a portion of the body to engage at least a portion of an outer jacket of the coaxial cable.

In other embodiments, the insulator is capable of limiting longitudinal movement of the contact assembly relative to the body.

In another aspect, an coaxial cable connector for attachment to a coaxial cable is disclosed, the coaxial cable having a center conductor, a dielectric layer surrounding the center conductor, and an outer conductor surrounding the dielectric layer, the coaxial cable connector including a body having a front end, a back end, a longitudinal opening extending between the front end and the back end along a longitudinal axis, a post fixedly mounted within the body and having a circumferential groove in an inside surface thereof, and a contact assembly movably mounted to the post and capable of moving longitudinally relative to the body, the contact assembly including a guide having an opening therein to receive the center conductor of the coaxial cable and at least one projection configured to engage the circumferential groove in a first position, and a contact element having a fixed relationship to the guide and having a front end, a back end, and an opening extending between the front end and the back end to receive an electrical contact, wherein the contact assembly is capable of moving along the longitudinal axis toward the front end of the coaxial cable connector in response to insertion of the coaxial cable into the back end of the coaxial cable connector, wherein the front end of the contact element is disposed adjacent the front end of the body when the coaxial cable is fully inserted into the back end of the coaxial cable connector.

In another aspect, a combination of an adapter for a coaxial cable connector and coaxial cable connector for coupling an end of a coaxial cable to a terminal is disclosed, the combination includes a body having a front end, a back end, a longitudinal opening extending between the front end and the back end along a longitudinal axis, a post fixedly mounted within the body and having a circumferential groove in an inside surface thereof, and a contact assembly movably mounted to the post and capable of moving longitudinally relative to the body, the contact assembly includes a guide having an opening therein to receive the center conductor of the coaxial cable and a contact element having a fixed relationship to the guide, and an adapter configured to be disposed on the front end of the coaxial cable connector body, the adapter includes a main body having a first end, a second end, and an interior surface defining an opening therethrough between the first end and the second end, the opening configured to pass over the front end of the coaxial cable connector, a forward facing surface configured to engage a portion of the body of the coaxial cable connector, and a rearward facing surface at the first end configured to engage a tool to compress the coaxial cable connector.

In yet another aspect, a method of assembling a coaxial cable connector is disclosed, the method includes the steps of providing a coaxial cable connector having a body with a front end, a back end, a hexagonal portion, and a longitudinal opening extending between the front end and the back end along a longitudinal axis, inserting a post into the body from the back end of the body, inserting a contact assembly into the post so that the contact assembly is capable of moving longitudinally relative to the body, inserting a coaxial cable into the contact assembly of the coaxial cable connector, disposing an adapter over the front of the body of the coaxial connector, and axially compressing the adapter and the connector relative to one another thereby axially compressing the coaxial cable connector to secure the coaxial cable in the coaxial cable connector.

Additional features and advantages of the invention will be set forth in the detailed description which follows and, in part, will be readily apparent to those skilled in the art from that description or recognized by practicing the invention as described herein, including the detailed description which follows, the claims, and the appended drawings.

It is to be understood that both the foregoing general description and the following detailed description of the present embodiments of the invention are exemplary and explanatory, and are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and, together with the description, serve to explain the principles and operations of the invention.

BRIEF DESCRIPTION OF THE DRAWINGS

FIGS. 3A-D are views of an adapter to be used with a coaxial cable connector;

FIG. 4 is a cross-sectional view of the connector of FIG. 1 at a first stage of attachment of the coaxial cable;

DETAILED DESCRIPTION

Figure 1:
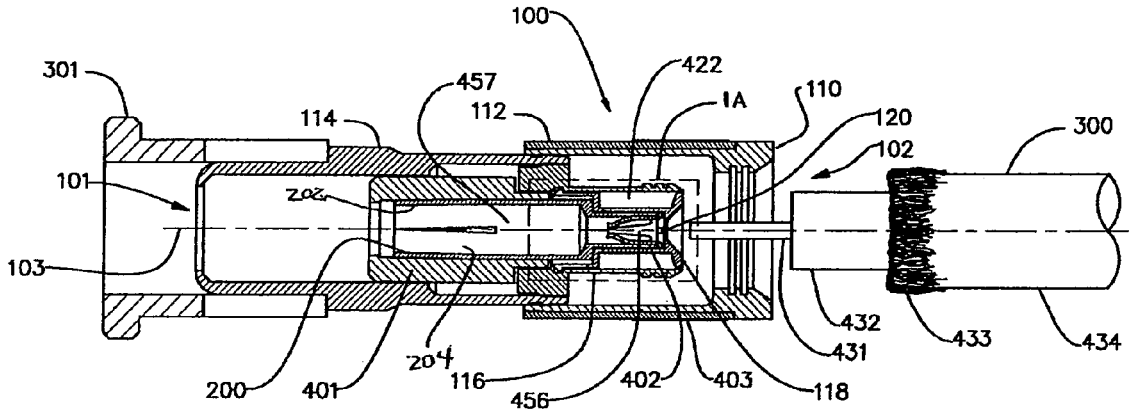
FIG. 1 is a cross-sectional view of one embodiment of a connector according to the present invention.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIGS. 1-7, an axially-compressible connector 100 is illustrated in accordance with one embodiment of the present invention, and in this embodiment takes the form of an RCA connector. FIG. 1 shows the connector 100 prior to attachment together of the connector 100 and a coaxial cable 300. FIG. 1 shows the connector 100 as it preferably appears prior to use, such as during transport, or shipment, and during storage, hereinafter an "as shipped" state (without the coaxial cable 300). The connector 100 is generally tubular, and has a front end 101, a back end 102, and a central longitudinal axis 103. The front end 101 is configured to be removably attached to a terminal (not shown) having a male conductor and, as illustrated, may include an adapter 301 that allows the use of a single tool for multiple connectors to axially compress the connector, as discussed in more detail below. The back end 102 is for attachment to coaxial cable 300. The connector 100 also has a compression ring 110 that has a generally tubular shape and is preferably made from plastic. A tubular shaped shell 112 is mounted on the outside of the compression ring 110 and is preferably made of metal. The compression ring 110 is mounted onto a body 114, preferably by a press-fit and is preferably also made of metal. A generally tubular shaped post 116 is mounted within the body 114 and is also preferably made of metal. A generally tubular shaped guide 118, which is preferably a dielectric, is mounted within the post 116. The compression ring 110, shell 112, body 114, post 116 and guide 118 share the same longitudinal axis 103. A small opening in the guide 118 near the back end 102 of the connector 100 at the longitudinal axis 103 forms a target 120 that is near the back end 102.

The connector 100 also includes a contact 200 that is an integral part of the connector 100 when shipped. The contact 200 does not extend beyond the front end 101 of the connector 100 when in the "as shipped" state. As a result, the body 114 of the connector 100 protects the contact 200 from damage during shipment. The connector 100 also includes an insulator body 401 that supports a front portion of the contact 200 and maintains the contact 200 along the longitudinal axis 103 of the connector 100. The insulator body 401 is a generally tubular support made of electrically insulative material. The contact 200 has an inner surface 202 defining a cylindrical bore 204 along the longitudinal axis 103 of the contact 200. The cylindrical bore 204 includes a narrower portion 456 nearest the back end of the contact 200, and a wider portion 457 closer to the front end 101 of the contact 200. The connector 100 includes spring clip, or clip, 402 mounted within the narrower portion 456 of the bore 204. The clip 402 is described in more detail in U.S. Pat. No. 7,153,159, assigned to the same assignee as the current assignee, the contents of which are expressly incorporated by reference herein.

The guide 118, the contact 200 and the clip 402 together make up a contact assembly. The contact assembly is capable of moving longitudinally as a unit relative to the body 114.

A label 403 is optionally affixed to the outer surface of the shell 112.

The cable 300, as is known in the art, has a center conductor 431, surrounded by a dielectric layer 432, such as a foam core, surrounded by an outer conductor 433, which in turn is surrounded by a jacket 434.

Figure 2:
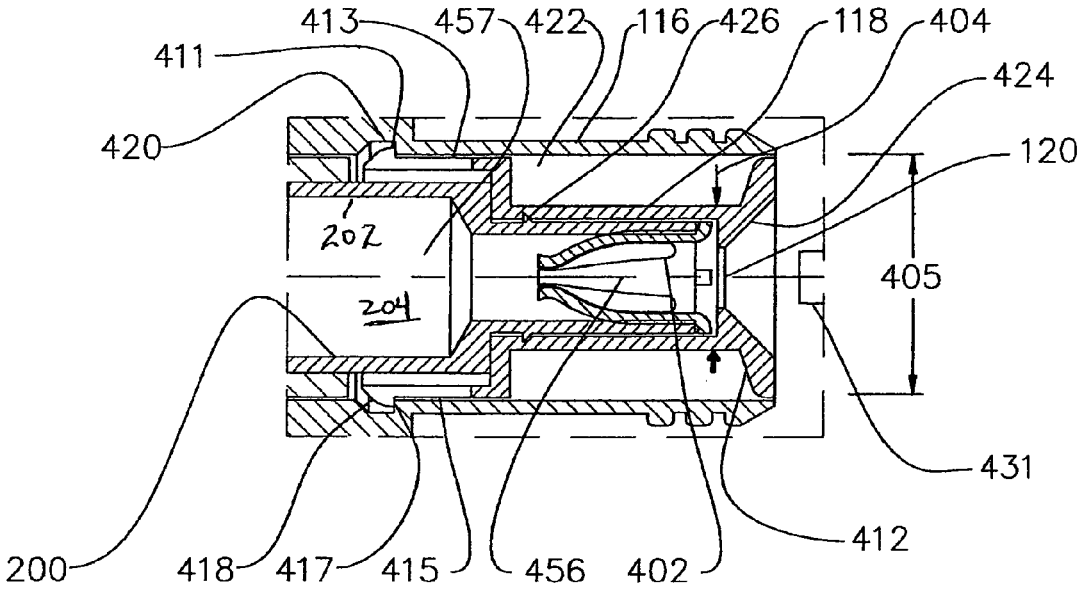
FIG. 2 is an enlargement of Area 1A of FIG. 1.

FIG. 2 is an enlarged view of Area 1A of FIG. 1. The post 116 has an inner surface defining a cylindrical bore 422 along the longitudinal axis 103 of the length of post 116. The guide 118 is mounted within the cylindrical bore 422 of the post 116. The guide 118 includes a middle portion having an outer diameter 404, and integral front and back flanges 411 and 412, each having a larger outer diameter than outer diameter 404, such as outer diameter 405 of the back flange 412. A front portion of the guide 118, including the front flange 411, has a plurality of axial slits forming a plurality of segments. In one preferred embodiment, the front portion of the guide 118 has two (2) axial slits, thereby forming four (4) segments. Segments 413 and 415 are visible in FIG. 2. The front flange 411 has a shoulder 417 preferably formed by a sharp corner on a back side of the front flange 411, and a chamfered, tapered or rounded surface 418 on a front side of the front flange 411. The inner surface of the post 116 is provided with corresponding annular groove 420. A forward facing surface of the groove 420 is at about a right angle to the inner surface of the post 116 to engage the shoulder 417 to prevent the post 118 from moving rearwardly. The rearward facing surface of the groove 420 is angled to allow the chamfered surface 418 of front flange 411 to be forced radially inward out of and past the groove 420. A rear portion of the guide 118 preferably includes an angled surface 424, forming a funnel, which aids in the insertion of the center conductor 431 of the cable 300 into the target 120. In preferred embodiments, the guide 118 is machined or molded from a plastic material such as acetal. The location of the guide 118 and contact 200 being near the back end 102 of the connector 100 reduces the blind entry of the cable 300. The diametral relationship between the guide 118 and the groove 420 in the post 116 ensures that the guide 118 engages the inner surface of the post 116 and keeps the contact 200 centered in the bore 422 of the post 116. The larger outer diameter 405 of the back flange 412 is sized to further assist the centering of the guide 118 in the bore 422 of the post 116. In preferred embodiments, the guide 118 is engaged to the contact 200 by means of a metallic barb 426 in the contact, which embeds itself in the guide 118.

FIGS. 3A-C illustrate the adapter 301 that is used with the connector 100 to axially compress the connector. As is known in the art, there are several different connector interfaces, including F-type, RCA, and BNC, among others. In order to permanently attach the connector to the coaxial cable, a tool must be used to compress the connector on the coaxial cable, either radially or axially. In the present invention, the connectors are axially compressible. However, each of the coaxial cable connector interfaces has a different diameter and length, requiring a different tool or a single tool with different inserts to accommodate the different cable connector interfaces. If the installer does not have the correct tool or the insert has been lost or misplaced, the installer has a difficult, if not impossible, time of correctly installing the coaxial cable connector. The present invention includes an adapter, such as adapter 301 that can be shipped on the front end of the coaxial cable connector and will replace the inserts that are now required. As illustrated in FIGS. 3A-C, an adapter 301 has a main body 303, an annular projection 305 at a back end 307, and a plurality of slits 309 extending from the front end 311 toward the back end 307. The annular projection 305 allows for engagement with an installation tool, not shown, but may not be needed with certain tools. The adapter 301 has an inner surface 313 that defines an opening 315 that is sized to the appropriate connector. For example, the opening 315 for an adapter for a BNC connector will be larger than that for an RCA connector.

Figure 16:
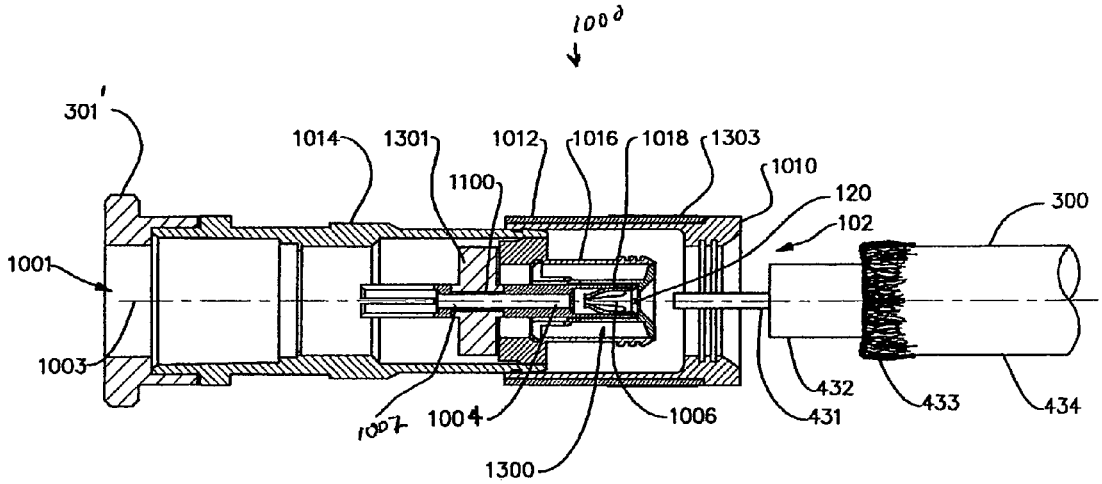
FIG. 16 is a cross-sectional view of another embodiment of a connector according to the present invention.

Additionally, as illustrated in an alternative embodiment of an adapter 301' in FIG. 3D, the internal surface 313' may have two different diameters thereby creating a forward-facing shoulder 317' that engages the front end of a connector rather than the front end 311' (as illustrated in FIG. 1, for example). Such an adapter is illustrated in FIG. 16 where the shoulder 317' engages the front of the connector. It should be noted that the distance between the shoulder 317' and the front end 311' may allow both or either of the surfaces (the shoulder or the front end) of the adapter 301,301' to engage corresponding structures on the connector. For example, if the distance between the shoulder 317' and the front end 311' is shorter than the distance between the front of the connector and a structure on the outside of the connector (such as a flange or the ears on the BNC connector), then the shoulder 317' will contact the connector and the front end 311' of the adapter will not be able to engage a corresponding structure on the connector (see, e.g., FIG. 16). However, the opposite could also be true where the distance between the shoulder 317' and the front end 311' is longer than the distance between the front of a connector and a structure on the connector so that the end 311' engages the structure on the connector rather than the shoulder 317'. Another embodiment of an adapter is described in detail in an application filed concurrently herewith and has Ser. No. 11/895,314, the contents of which are incorporated by reference.

Figure 5:
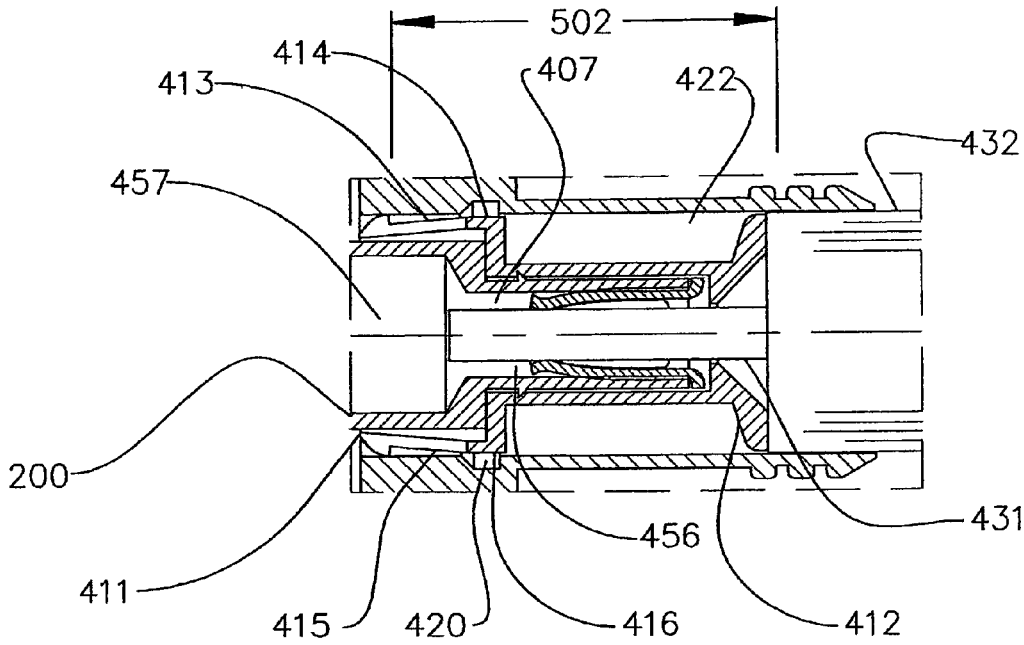
FIG. 5 is an enlargement of the Area 4A of the connector of FIG. 4.
Figure 6:
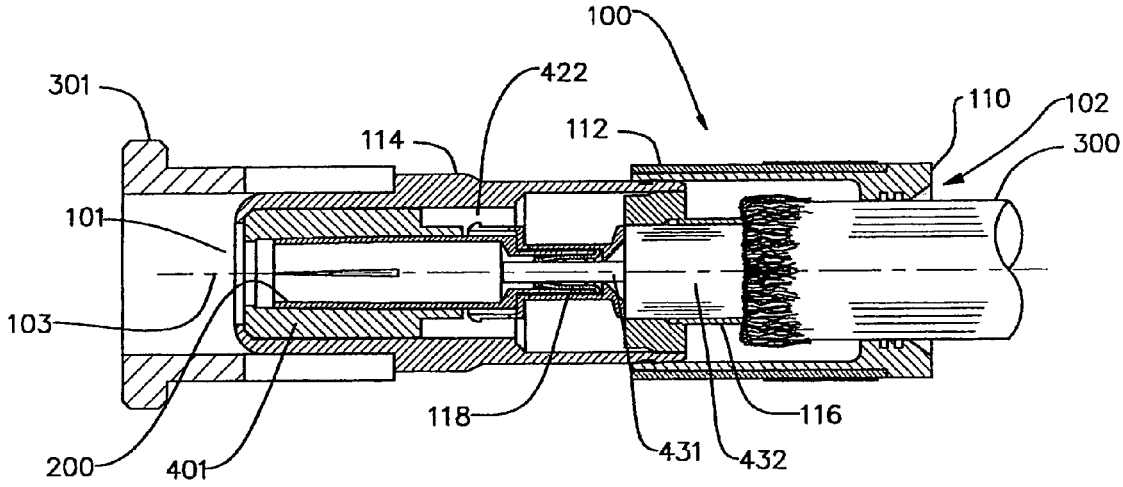
FIG. 6 is a cross-sectional view of the connector of FIG. 1 at a second stage of attachment of the coaxial cable.

FIG. 4 is a cross-sectional view of the connector 100 at a first stage of attachment with coaxial cable 300 and FIG. 5 is an enlarged view of the area 5A in FIG. 4. In these figures, the cable 300 is partially inserted so that the center conductor 431 has entered the narrower portion 456 of the bore of the contact 200 and the clip 402. A standard cable preparation tool exposes the center conductor 431 of the cable 300 a shorter amount than distance 502. As a result, the dielectric layer 432 of the cable 300, and not the center conductor 431 of the cable 300, pushes directly on the guide 118 to push the contact assembly forward into body 114. In FIG. 5, the contact assembly has been moved forward an intermediate distance relative to the post 116 as a result of the dielectric layer 432 pushing against the guide 118. As can be seen in FIG. 6, the flanges 411 have been deflected inward and out of the annular groove 420. The four slotted segments (only segments 413 and 415 are shown) of the guide 118 are designed to deflect inward at bendable points 414, 416 as a result of the force by inserting the coaxial cable 300. The center conductor 431 makes electrical contact with the clip 402, which in turn is in electrical contact with the contact 200. Since guide 118 is a dielectric, it insulates the body 114 from the contact assembly.

FIG. 6 is a cross-sectional view of the connector 100 showing a second stage of attachment with the cable 300 fully seated. In FIG. 6, the contact 200 is in a final position, that is, the contact 200 is in the appropriate position for mating with a male connector at the front end 101. The final positioning of the contact 200 is when the insulator body 401 engages the inside surface of body 114 at the front end 101 of connector 100. An advantage of the connector 100 is that proper seating of the cable 300 is indicated by the final position of the contact 200 as the contact 200 provides visual confirmation of proper insertion of the cable 300.

Figure 7:
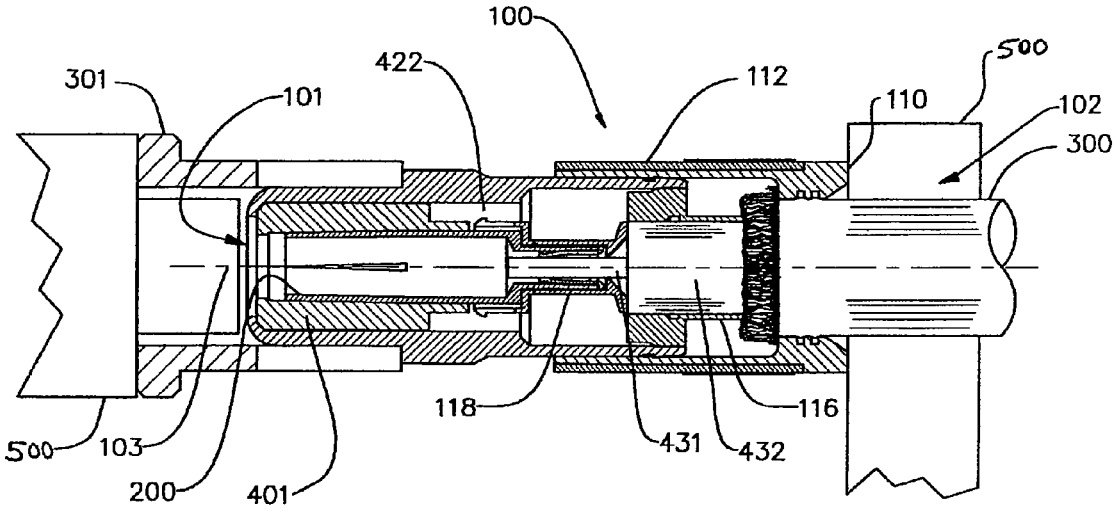
FIG. 7 is a cross-sectional view of the connector of FIG. 1 fully assembled and illustrating a portion of the compression tool engaging the connector and the adapter.

FIG. 7 is a cross-sectional view of the connector 100 and the cable 300 assembled together with the contact 200 remaining in its final position. Also illustrated in FIG. 7 is the adapter 301 engaged in one portion of a tool 500 and the front end of the connector 100, as well as a second portion of the tool 500 engaging the back end 102 of the connector 100. After the tool 500 is activated, the compression ring 110 is moved forward and into a closed position, engaging the outer conductor 433 and the jacket 434 of the cable 300 with the post 116. The tool 500 and the adapter 301 are then removed and the connector 100 is in an "in use" state.

FIGS. 8-11 show another embodiment of a connector 2100 according to the present invention, the connector 2100 has an alternative contact 200' with a disposable front guide 2150. The connector 2100 is also generally tubular, and has a front end 101', a back end 102', and a central longitudinal axis 103'. The front end 101' is configured to be removably attached to a terminal having a male contact (not shown) and, although not illustrated, can be used with the adapter 301 as discussed above. The back end 102' is for attachment to coaxial cable 300. The connector 2100 also has a compression ring 110' that has a generally tubular shape that is preferably made from plastic. A tubular shaped shell 112' is mounted on the outside of the compression ring 110' and is preferably made of metal. The compression ring 110' is mounted onto a body 114', preferably by a press-fit and preferably made of metal. A generally tubular shaped post 116' is mounted within the body 114' and is also preferably made of metal. A generally tubular shaped guide 118', which is preferably a dielectric, is mounted within the post 116'. The compression ring 110', shell 112', body 114', post 116' and guide 118' share the same longitudinal axis 103'. A small opening in the guide 118' near the back end 102' of the connector 100' along the longitudinal axis 103' forms a target 120'. The post 116' and the guide 118' have the same structures and operate in the same manner relative to one another as noted above with respect to connector 100.

Figure 8:
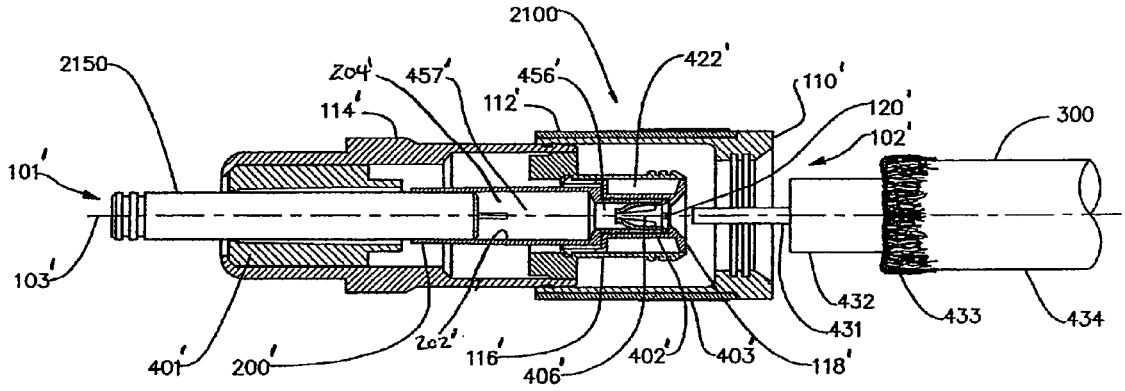
FIG. 8 is a cross-sectional view of the another embodiment of a connector according to the present invention.

FIG. 8 illustrates a cross-sectional view of the connector 2100 prior to attachment to the coaxial cable. The cross-sectional view of FIG. 8 shows the connector 2100 in an "as shipped" state, with a prepared cable 300 ready for insertion. In a preferred embodiment, the contact 200' is recessed within the body 114'. The connector 2100 includes an insulator body 401' that supports a front portion of the disposable guide 2150 inserted into contact 200' and maintains the contact at the central longitudinal axis 103' of the connector 2100 rather than being disposed around the contact assembly in the "as shipped" configuration of the first embodiment. Preferably, the insulator body 401' is a generally tubular support made of electrically insulative material. The contact 200' has an inner surface 202' defining a cylindrical bore 204' along the longitudinal axis 103' of the contact. The cylindrical bore 204' includes a narrower portion 456' nearest the back end of the contact 200', and a wider portion 457' farther from the back end of the contact 200'. The connector 2100 includes spring clip, or clip, 402' mounted within the narrower portion 456 of the bore. The guide 118', the contact 200', the clip 402', and disposable front guide 2150 together make up a contact assembly. The contact assembly is capable of moving longitudinally, as a unit, relative to the body 114'. A label 403' is optionally affixed to the outer surface of the shell 112'.

Figure 9:
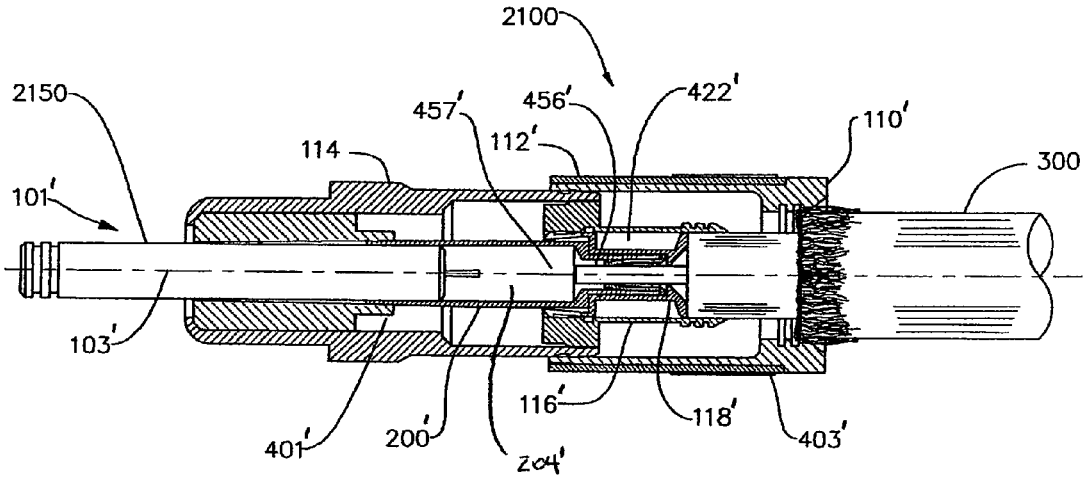
FIG. 9 is cross-sectional view of the connector of FIG. 8 at a first stage of attachment of the coaxial cable.

FIG. 9 is a cross-sectional view of the connector 2100 and the cable 300 at a first stage of attachment. FIG. 9 shows the cable 300 partially inserted into connector 2100. A tip of the center conductor 431 of the cable 300 has entered the narrower portion 456' of the bore 204' of the contact 200'. The dielectric layer 432 of the cable 300, and not the center conductor 431 of the cable 300, pushes directly on the guide 118' to push the contact assembly forward into body 114'. The disposable front guide 2150 maintains the contact 200' along the central longitudinal axis 103' of the connector 2100 and disposed in the opening of insulator body 401'. In FIG. 9, the contact assembly has been moved forward an intermediate distance as a result of the dielectric layer 432 pushing against the guide 118'.

Figure 10:
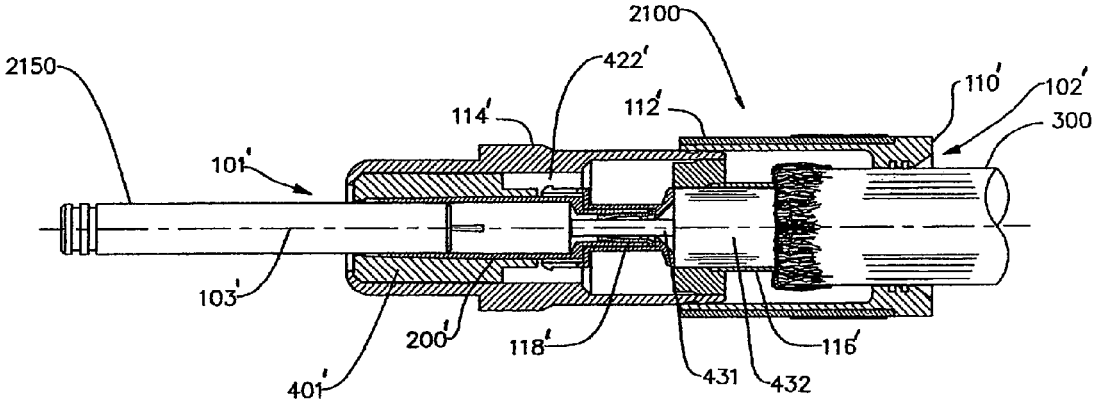
FIG. 10 is a cross-sectional view of the connector of FIG. 8 at a second stage of attachment of the coaxial cable.

FIG. 10 is a cross-sectional view of the connector 2100 and the cable 300 at a second stage of attachment. FIG. 10 shows the cable 300 fully seated where the contact 200' is in a final position, that is, the contact 200' is in the appropriate functional relationship relative to the front end 101' of the connector 2100 and insulator body 401'. One advantage of the connector 2100 is that proper seating of the cable 300 is indicated by the final position of the disposable front guide 2150. The disposable front guide 2150 provides visual continuation of proper insertion of the cable 300.

Figure 11:
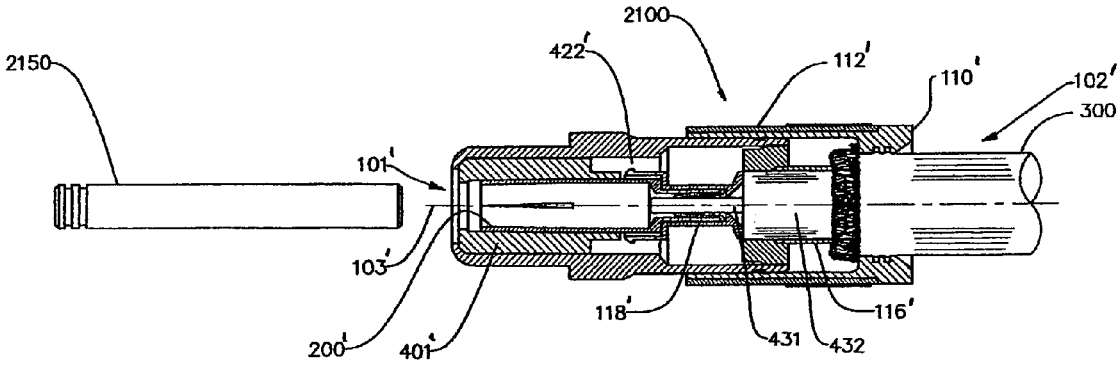
FIG. 11 is a cross-sectional view of the connector of FIG. 10 with the front guide removed therefrom.

FIG. 11 is a cross-sectional view of the connector 2100 and the cable 300 assembled together with the contact 200' remaining in the fully forward position. FIG. 11 shows the compression ring 110' moved into a closed position, which pinches the outer conductor 433 and the jacket 434 of the cable 300 with the post 116'. In FIG. 11, the connector 2100 is shown in an "in use" state with the contact 200' adjacent the front end 101' and the disposable front guide 2150 has been removed and is ready to be connected to another male configured terminal or cable.

While not illustrated in FIG. 8, the connector 2100 may also be shipped with an adapter 301 mounted on the front end 101'. As noted above, the adapter 301 has an opening 315 that would accommodate the disposable front guide 2150 while the adapter 301 is mounted on the front end 101 of the connector 2100.

Figure 12:
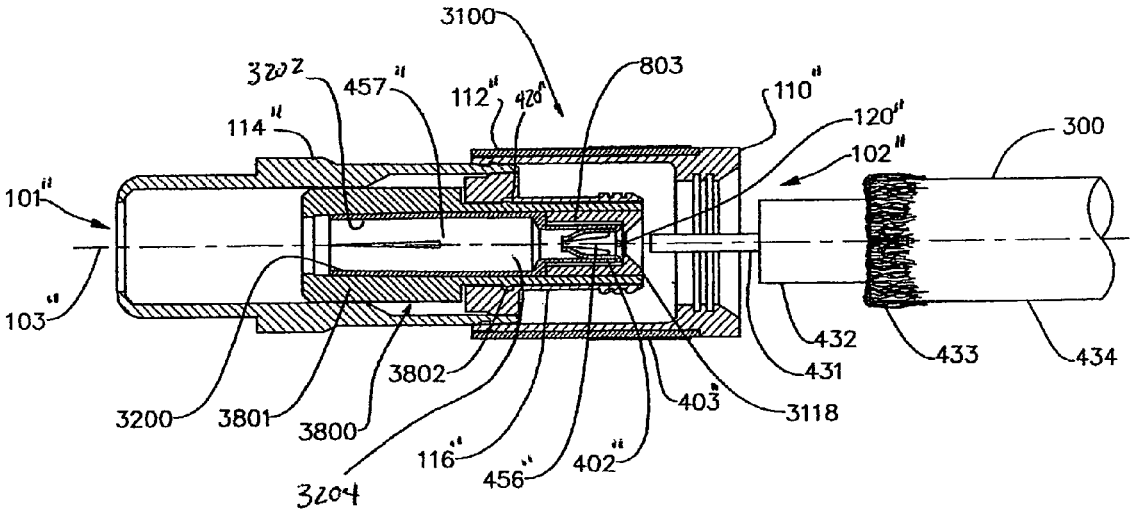
FIG. 12 is a cross-sectional view of another embodiment of a connector according to the present invention.

FIGS. 12-15 illustrate another embodiment of a connector 3100 according to the present invention. FIG. 12 is a cross-sectional view of the connector 3100 and cable 300 prior to attachment together. FIG. 12 shows the connector 3100 in the same preferred "as shipped" state with a prepared cable 300 ready for insertion. The connector 3100 is also generally tubular, and has a front end 101", a back end 102", and a central longitudinal axis 103". The front end 101" is configured to be removably attached to a terminal with a male contact (not shown) and, although not illustrated, can be used with the adapter 301 discussed above. The back end 102" is for attachment to coaxial cable 300. The connector 3100 also has a compression ring 110" that has a generally tubular shape that is preferably made from plastic. A tubular shaped shell 112" is mounted on the outside of the compression ring 110" and is preferably made of metal. The compression ring 110" is mounted onto a body 114", preferably by a press-fit and preferably made of metal.

Figure 13:
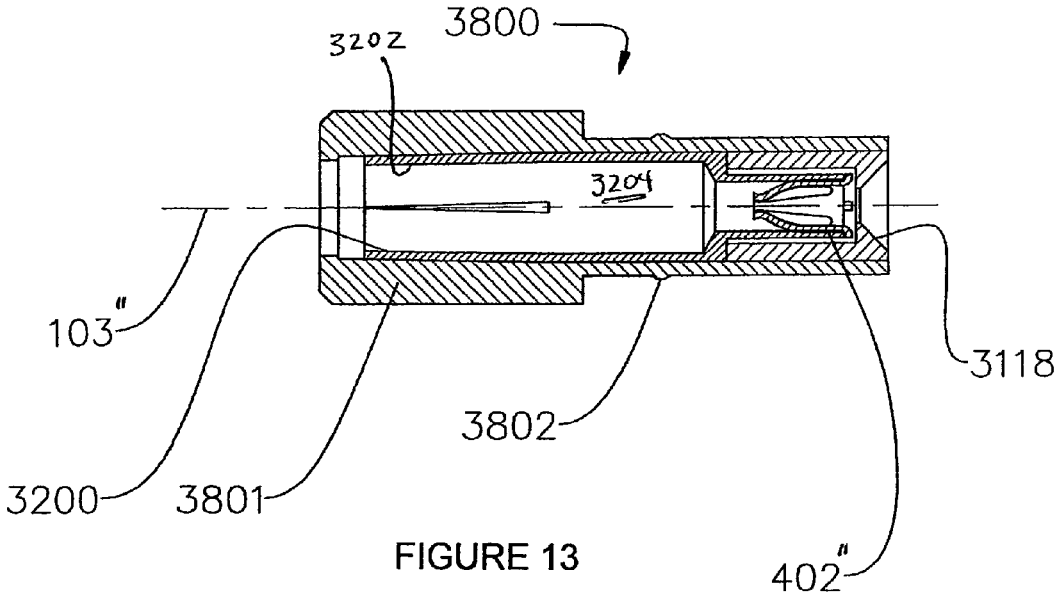
FIG. 13 is an enlargement of contact assembly of the connector of FIG. 12.

The connector 3100 includes an insulator body 3801 that supports a front portion of the contact 3200 and maintains the contact 3200 along the longitudinal axis 103" of the connector 3100. The insulator body 3801 is a generally tubular support made of electrically insulative material. The contact 3200 has an inner surface 3202 defining a cylindrical bore 3204 along the longitudinal axis 103" of the contact. The bore 3204 extends into the contact 3200 from the back end of the contact 3200 and the bore 3204 extends there-through. The bore 3204 includes a narrower portion 456" nearest the back end of the contact 3200, and a wider portion 457" closer to the front end 101" of the contact 3200. The connector 3100 includes spring clip, or clip, 402" mounted within the narrower portion 456" of the bore 3204. A rear insulator or guide 3118, preferable machined or molded from a plastic material such as acetal, is near the back end 102" of the connector 3100 and particularly surrounds the narrower portion 456" of the bore 3204 to reduce the blind entry of the cable 300. The rear insulator 3118, the insulator body 3801, the contact 3200 and the clip 402" make up a contact assembly 3800 as illustrated in FIG. 13. The contact assembly 3800 is capable of moving longitudinally, as a unit, relative to the body 114".

A label 403 is optionally affixed to the outer surface of the shell 112". The cable 300 comprises a center conductor 431, surrounded by a dielectric layer, such as a foam core, 432, surrounded by an outer conductor 433, surrounded by a jacket 434.

Returning to FIG. 12, the contact assembly 3800 is mounted within the bore of the post 116" in the "as shipped" state. The insulator body 3801 of contact assembly 3800 includes an annular ring 3802. The inner surface of the post 116" is provided with an annular groove 420" preferably in a front portion thereof. A forward facing surface of the groove 420" is at about a right angle to the inner surface of the post 116" to engage the annular ring 3802 and prevent the contact assembly 3800 from longitudinally sliding or backing out of the connector 3100. A rearward facing surface of the groove 420" is angled to allow the annular ring 3802 to be forced out of and past the groove to allow the assembly 3800 to move forward relative to the post 116" when a sufficient axial force in a forward direction is applied by the dielectric 432 of the coaxial cable 300 to the contact assembly 3800. The diametral relationship between the annular ring 3802 and the groove 420" in the post 116" ensures that the guide 3118 engages the inner surface of the post 116" and keeps the contact 3200 centered in the bore of the post 116".

Figure 14:
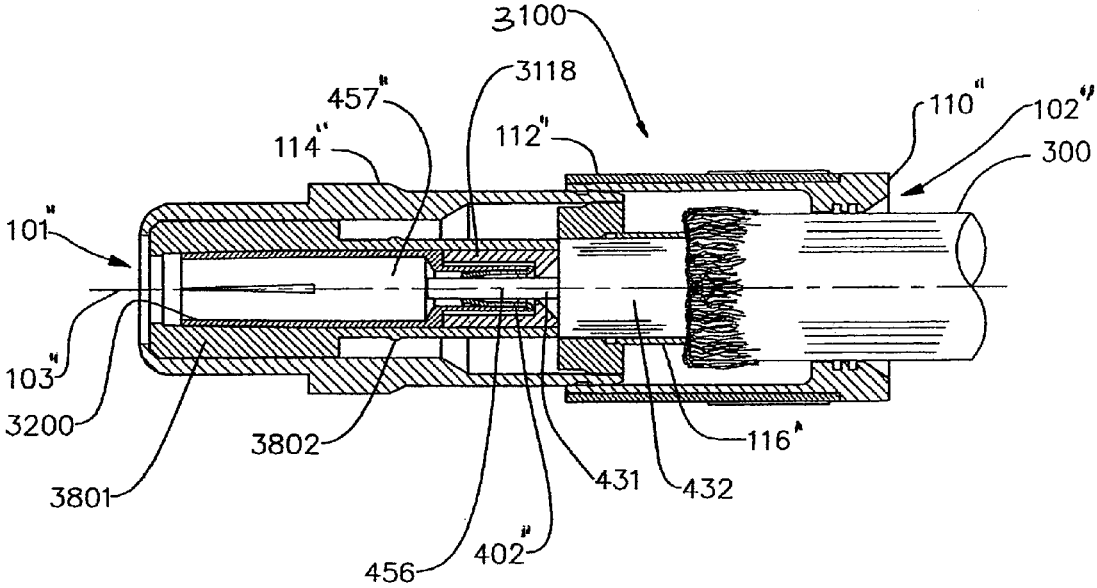
FIG. 14 is a cross-sectional view of the connector of FIG. 12 with the coaxial cable inserted therein.

FIG. 14 is a cross-sectional view of the connector 3100 and cable 300 showing a second stage of attachment. FIG. 14 shows the cable 300 fully seated with the contact 3200 is in a final position, that is, the contact 3200 is in the appropriate relationship to the front of the connector 3100. The dielectric layer 432 of coaxial cable 300 has pushed the contact assembly 3800 toward the front end 101" of the connector 3100 and out of the post 116". The contact assembly 3800 is maintained along the longitudinal axis 103" by the insulator body 3801.

Figure 15:
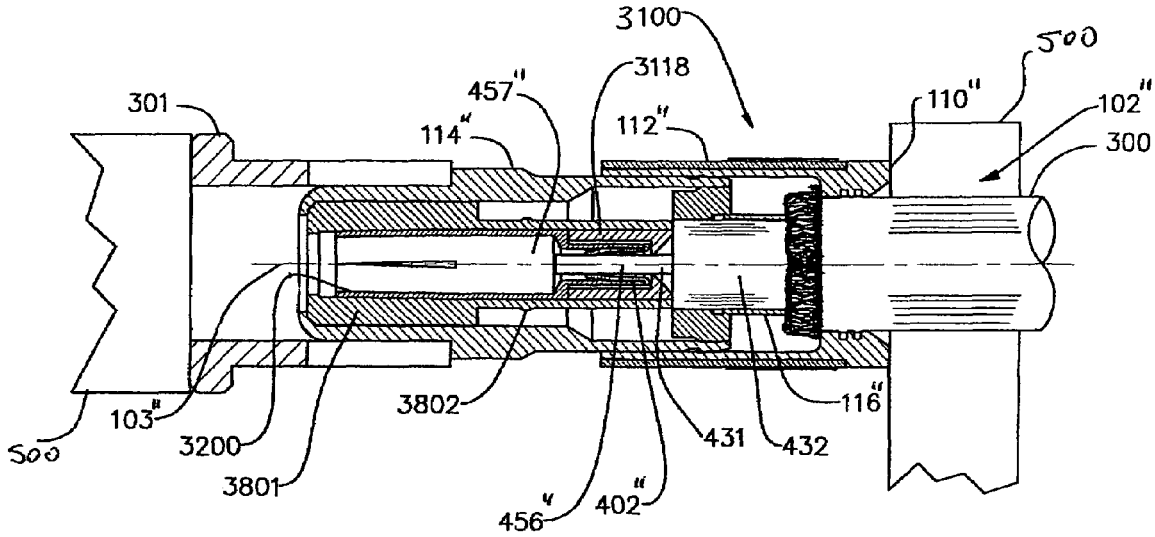
FIG. 15 is a cross-sectional view of the connector of FIG. 12 fully assembled and illustrating a portion of the compression tool engaging the connector and the adapter.

FIG. 15 is a cross-sectional view of the connector 3100 and the cable 300 assembled together with the contact 3200 in its final position. Also illustrated in FIG. 15 is an adapter 301 engaging in one portion of a tool 500 and the connector 3100, as well as a second portion of the tool 500 engaging the back end 102" of the connector 3100. After the tool is activated, the compression ring 110" is moved forward and into a closed position, engaging the outer conductor 433 and the jacket 434 of the cable 300 with the post 116". The tool 500 and the adapter 301 are then removed and the connector 3100 is in an "in use" state.

FIGS. 16-19 illustrate a cross-sectional view of another connector 1000 according to the present invention. The cross-sectional view of FIG. 16 shows the connector 1000 as a BNC connector in an "as shipped" state with a prepared cable 300 ready for insertion and an adapter 301' attached to the front end 1001 of the connector 1000.

The connector 1000 is generally tubular, and has a front end 1001, a back end 1002, and a central longitudinal axis 1003. The front end 1001 is for removable attachment to a terminal with a male contact (not shown). The back end 1002 is for attachment onto a coaxial cable. The connector 1000 includes a compression ring 1010 that is generally tubular shaped. A tubular shaped shell 1012 is mounted to the compression ring 1010. The compression ring 1010 is mounted onto a body 1014, preferably by a press fit. The compression ring 1010 is preferably plastic, while the shell 1012 and the body 1014 are preferably metallic. A generally tubular shaped post 1016 is mounted within the body 1014, and is preferably metallic. A generally tubular shaped guide 1018 is mounted within the post 1016, that is preferably a dielectric. The compression ring 1010, shell 1012, body 1014, post 1016 and guide 1018 all share the same longitudinal axis 1003.

The connector 1000 includes an insulator body 1301 that supports a front portion of the contact 1100 and maintains the contact at the central longitudinal axis 1003 of the connector 1000. Preferably, the insulator body 1301 is a generally tubular support made of electrically insulative material. The contact 1100 has a cylindrical bore 1104 along the longitudinal axis 1003 of the contact. Preferably, the bore 1104 includes a wider portion 1006 nearest the back end of the contact 1100 and a narrower portion 1007 closer to the front end of the contact 1100. At the front end of the contact 1100, the bore 1004 is sized to receive a male contact from the terminal (not shown). The connector 1000 includes a clip 1402 mounted within the wider portion 1006 of the bore 1104 at the rear of the contact 1100. The guide 1018, the contact 1100 and the clip 1402 make up a contact assembly 1300. The contact assembly 1300 is capable of moving longitudinally as a unit relative to the body 1014. A label 1303 is optionally affixed to the outer surface of the shell 1012.

Figure 17:
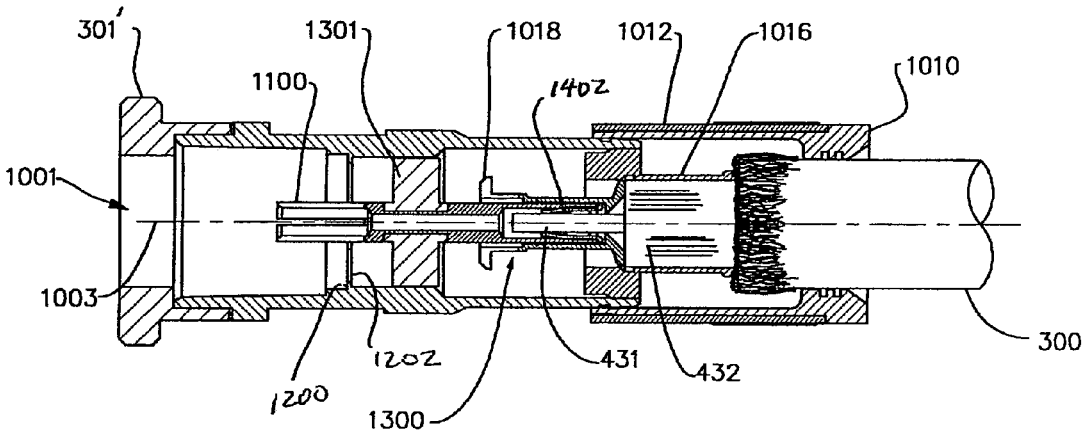
FIG. 17 is a cross-sectional view of the connector of FIG. 16 at a first stage of attachment of the coaxial cable.

FIG. 17 is a cross-sectional view of the connector 1000 and coaxial cable 300 at a first stage of attachment. FIG. 17 shows the cable 300 partially inserted into the connector 1000. The tip of the center conductor 431 of the cable 300 has entered into the bore 1104 of the contact 1100 at the rear thereof. A standard cable preparation tool is used to prepare the cable 300 such that the dielectric layer 432 of the cable 300, and not the center conductor 431 of the cable 300, pushes the contact assembly 1300 forward into the body 1014. In FIG. 17, the contact assembly 1300 has been moved forward an intermediate distance as a result of the dielectric layer 432 pushing against the guide 1018.

Figure 18:
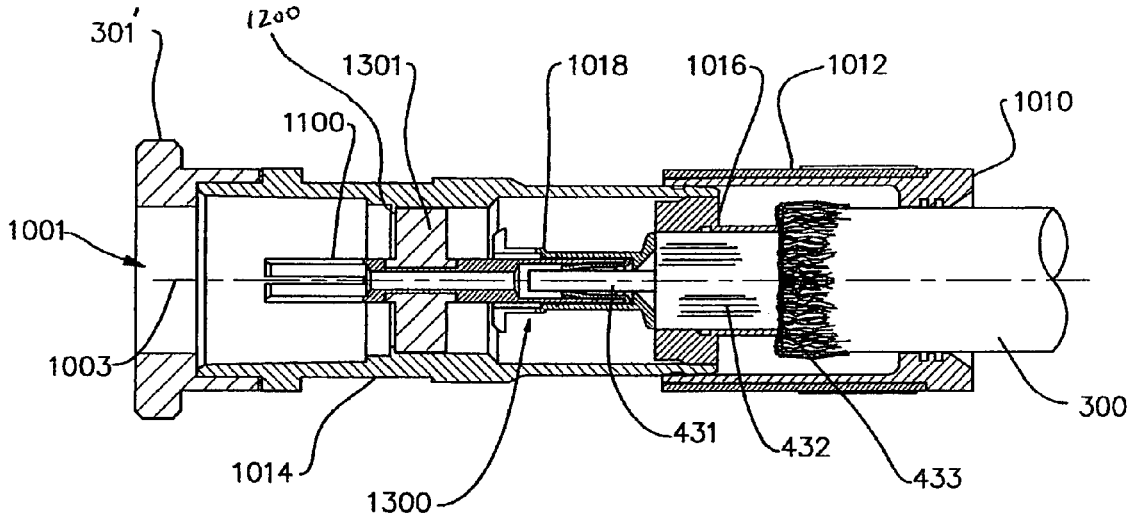
FIG. 18 is a cross-sectional view of the connector of FIG. 16 at a second stage of attachment of the coaxial cable.

FIG. 18 is a cross-sectional view of the connector 1000 and the cable 300 at a second stage of attachment. The body 1014 also has an annular projection 1200 with a rearward facing surface 1202. The annular projection 1200 extends preferably continuously around the interior of body 1014, but it may extend around only a portion of the circumference of the body 1014. The annular projection 1200, and the rearward facing surface 1202 in particular, are configured to engage the insulator body 1301 as it moves forward to prevent the contact assembly 1300 from moving too far toward the front end 1001. FIG. 18 shows the cable 300 fully seated such that the contact 1100 is in a final position, that is, the contact is fully pushed forward toward the front end 1001 where it, or more particularly the insulator body 1301, engages the rearward facing surface 1202, thereby limiting the longitudinal movement of the contact assembly 1300. An advantage of the connector 1000 is that proper seating of the cable 300 is confirmed by the final position of the contact 1100.

Figure 19:
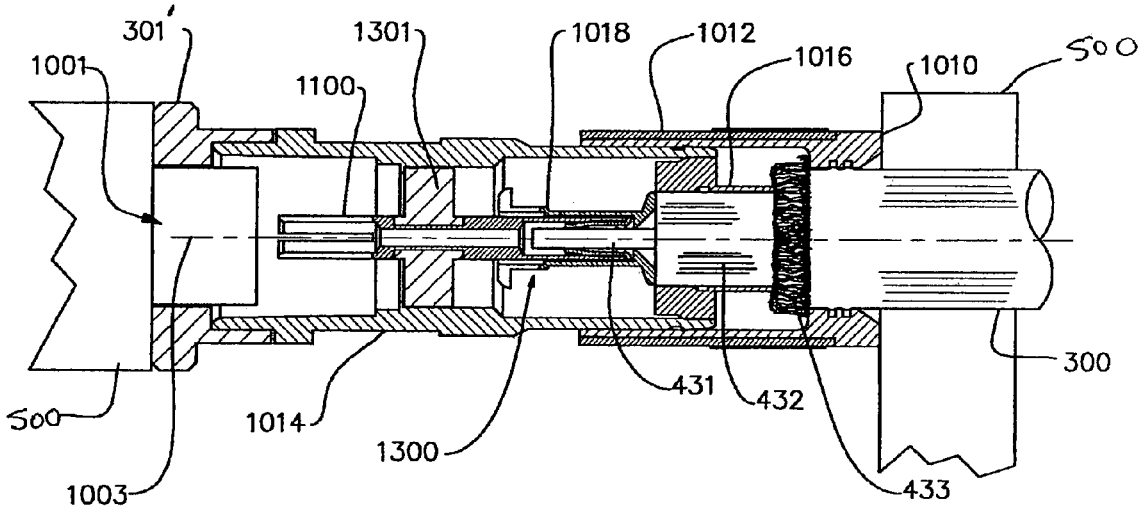
FIG. 19 is a cross-sectional view of the connector of FIG. 16 fully assembled and illustrating a portion of the compression tool engaging the connector and the adapter.

FIG. 19 is a cross-sectional view of the connector 1000 and the cable 300 attached together with the contact 1100 remaining in the fully forward position. FIG. 19 also illustrates the adapter 301' engaged with one portion of a tool 500 and the connector 1000, as well as a second portion of the tool 500 engaging the back end 1002 of the connector 1000. After the tool is activated, the compression ring 1010 is moved forward and into a closed position, engaging the outer conductor 433 and the jacket 434 of the cable 300 with the post 1016. The tool 500 and the adapter 301' are then removed and the connector 1000 is in an "in use" state.

Figure 20:
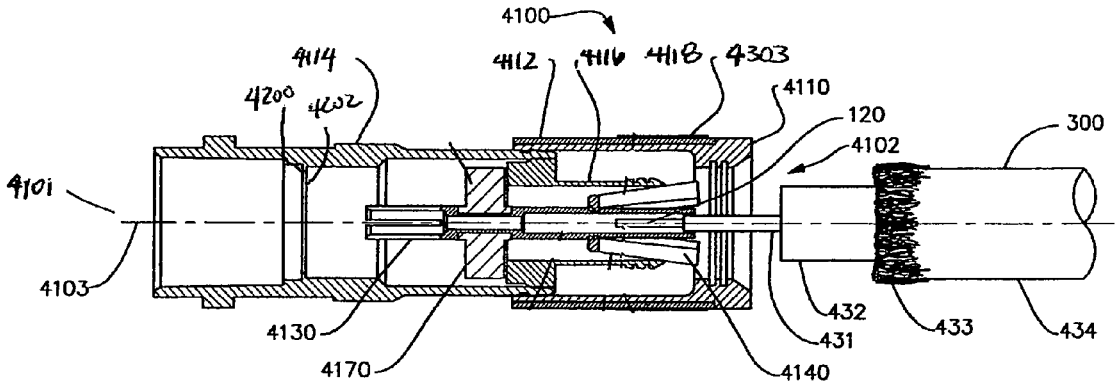
FIG. 20 is a cross-sectional view of another embodiment of a connector according to the present invention.

FIGS. 20-23 show another embodiment of a connector 4100 according to the present invention. FIG. 20 is a cross-sectional view connector 4100 and cable 300 prior to attachment to each other and in the preferred "as shipped" state.

The connector 4100 also includes a contact 4130 that is an integral part of the connector 4100 when shipped. The connector 4100 is generally tubular, and has a front end 4101, aback end 4102, and a central longitudinal axis 4103. The front end 4101 is for removable attachment to a terminal (not shown) and a male contact member. The back end 4102 is for attachment onto a cable. The connector 4100 includes a compression ring 4110 that is generally tubular shaped. A tubular shaped shell 4112 is mounted to the compression ring 4110. The compression ring 4110 is mounted onto a body 4114, preferably by a press fit. The compression ring 4110 is preferably plastic, while the shell 4112 and the body 4114 are preferably metallic. A generally tubular shaped post 4116 is mounted within the body 4114, and is preferably metallic. A sabot 4140 acts as a guide for the dielectric layer 432 of the cable 300 to enter the inner diameter of the post 4116. A detailed description of the sabot 4140 can be found in U.S. Pat. No. 7,153,159, previously incorporated by reference.

The connector 4100 includes an insulator body 4170 that supports a front portion of the contact 4130 and maintains the contact 4130 along the central longitudinal axis 4103 of the connector 4100. Preferably, the insulator body 4170 is a generally tubular support made of electrically insulative material that at least partially surrounds the contact 4130 and more preferably completely surrounds contact 4130. The guide 4118, the contact 4130 and the sabot 4140 make up a contact assembly. A label 4303 is optionally affixed to the outer surface of the shell 1012. The compression ring 4110, shell 4112, body 4114, post 4116, contact 4130, and sabot 4140 all share the same longitudinal axis 4103.

Figure 21:
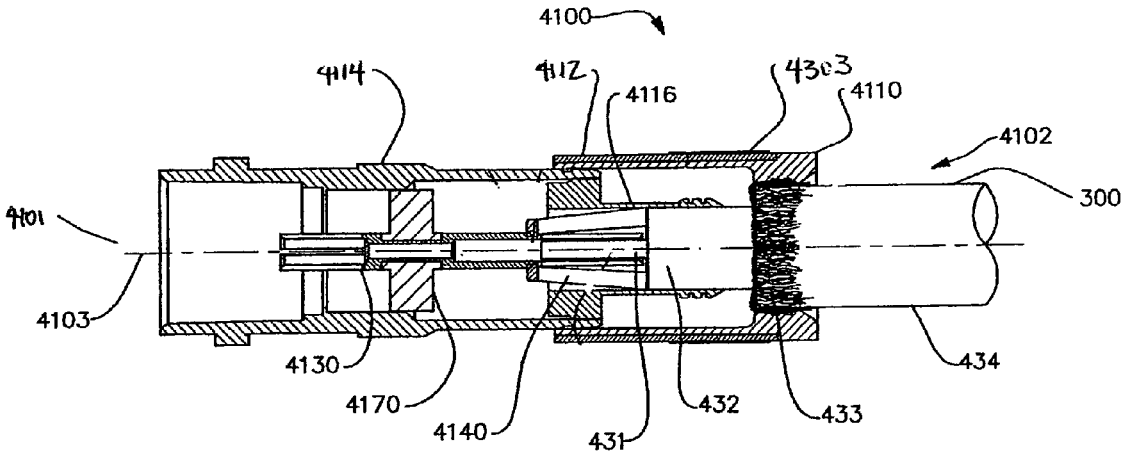
FIG. 21 is a cross-sectional view of the connector of FIG. 20 at a first stage of attachment of the coaxial cable.

As illustrated in FIG. 21, as the cable 300 is advanced and the dielectric 432 contacts the sabot 4140, the sabot 4140 hinges inward toward the longitudinal axis 4103 such that the sabot 4140 is partially closed by the inner diameter of the post 4116 around the contact 4130, and, together with the front insulator 4170, is urged forward. The sabot 4140 also engages the contact 4130, so that movement imparted to the rear side thereof (particularly by the cable 300) is also transmitted to the contact 4130.

Figure 22:
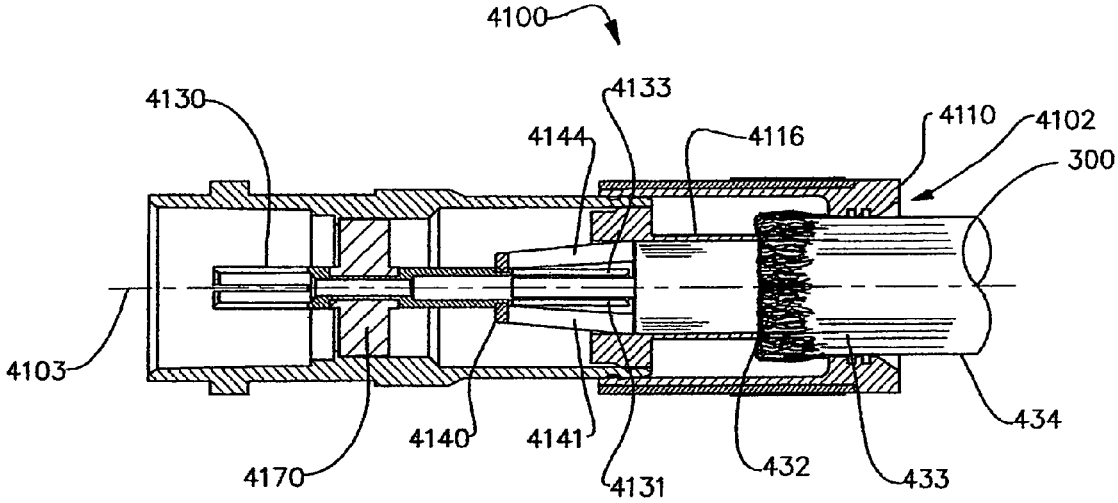
FIG. 22 is a cross-sectional view of the connector of FIG. 20 at a second stage of attachment of the coaxial cable.

FIG. 22 is a cross-sectional view of the connector 4100 and the cable 300 at a second stage of attachment, where the cable 300 is fully seated. The arms of the sabot 4140 are radially displaced inwardly within the bore of the connector post 4116, causing four metallic fingers 4131,4133,4141,4144 at the back end of the sabot 4140 to close around the contact 4130, and preferably on, the center conductor 431 of the cable 300. The front insulator body 4170 also contacts an annular projection 4200 that has a rearward facing surface 4202 to prevent the contact 4130 from traveling too far forward.

Figure 23:
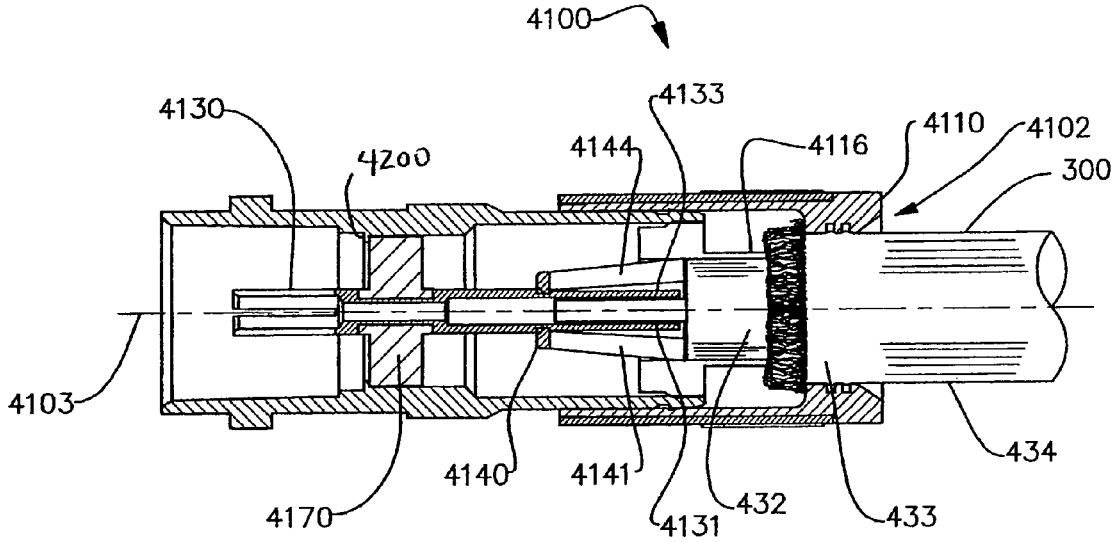
FIG. 23 is a cross-sectional view of the connector of FIG. 20 fully assembled.

FIG. 23 is a cross-sectional view of the connector 4100 and the cable 300 at a third stage of attachment. FIG. 23 shows the compression ring 4110, moved into the closed position, which captures the outer conductor 433 and the jacket 434 of the cable 300 between the compression ring 4110 and the post 4116 by an appropriate tool, such as that described above along with an appropriate adapter, such as adapter 301.

Figure 24:
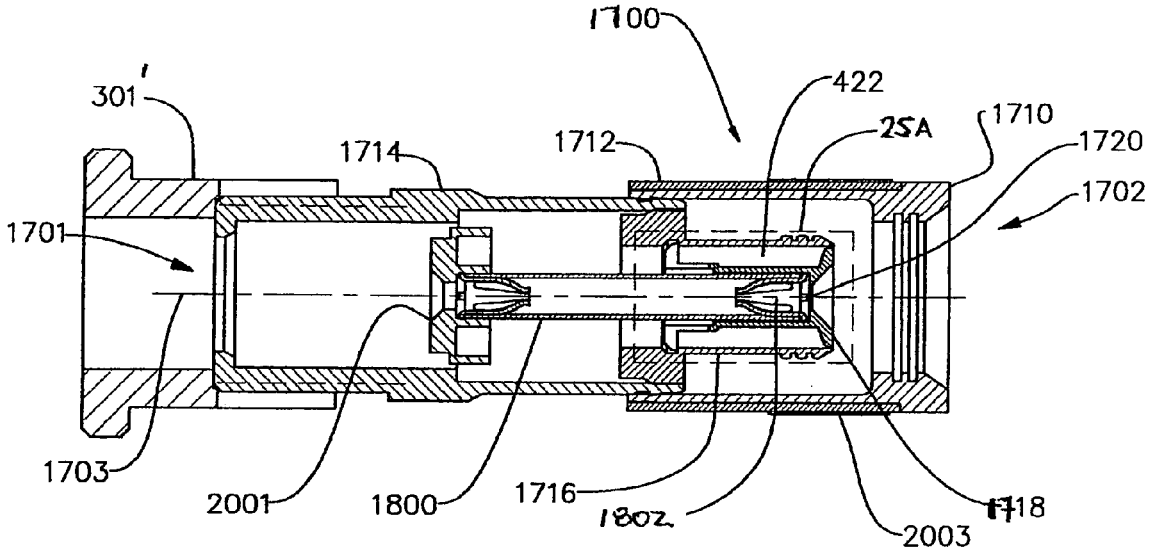
FIG. 24 is a cross-sectional view of another embodiment of a connector according to the present invention having an adapter placed thereon.

FIGS. 24-28 illustrate a cross-sectional view of another connector 1700 according to the present invention. The cross-sectional view of FIG. 24 shows the connector 1700 as a F-type connector in an "as shipped" state with a prepared cable 300 ready for insertion and an adapter 301' attached to the front end 1701 of the connector 1700.

FIG. 24 shows the connector 1700 that is generally tubular, and has a front end 1701, a back end 1702, and a central longitudinal axis 1703. The front end 1701 is for removable attachment to a terminal (not shown) and a male contact. The back end 1702 is for attachment onto the coaxial cable 300. The connector 1700 includes a compression ring 1710 that is generally tubular shaped, which is preferably plastic, and more preferably, is molded acetal. A tubular shaped shell 1712 is mounted to the compression ring 1710, and is preferably metallic. The compression ring 1710 is mounted onto a body 1714, preferably by a press-fit and is preferably metallic. A generally tubular shaped post 1716 is mounted within the body 1714 and also preferably metallic. A generally tubular shaped guide 1718 is mounted within the post 1716 and is preferably a dielectric. The compression ring 1710, shell 1712, body 1714, post 1716 and guide 1718 all share the same longitudinal axis 1703.

Figure 25:
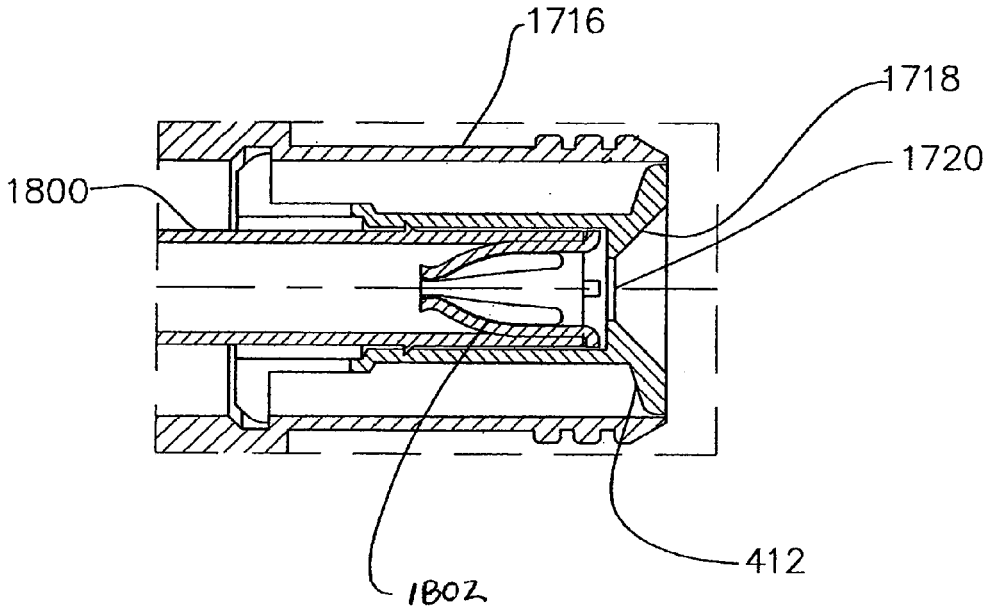
FIG. 25 is an enlargement of the Area 24A of the connector of FIG. 24.

FIG. 25 is an enlargement of Area 25A of FIG. 24 and shows the contact assembly and guide 1718. The guide 1718 is similar to the guides in the prior embodiments in that includes a middle portion having an outer diameter and integral front and back flanges. The front flange of guide 1718 also has a shoulder preferably formed by a sharp corner on the back side and a rounded surface on a front side of the front flange to engage and the corresponding annular groove of the post as noted above. Similarly, the rear portion of the guide 1718 also preferably includes an angled surface that forms a target 1720 for entry of the coaxial cable. In preferred embodiments, the guide 1718 is machined or molded from a plastic material such as acetal. The location of the guide 1718 and contact 1800 being near the back end 102 of the connector 100 reduces blind entry of the cable 300. Also, the guide 1718 is engaged to the contact 1800 by means of a metallic barb in the contact 1800, which embeds itself in the guide 1718.

The end of contact 1800 is recessed within the body 1714 during shipment and also within an insulator body 2001 that supports a front portion of the contact 1800 and maintains the contact 1800 along the longitudinal axis 1703 of the connector 1700. Preferably, the insulator body 2001 is a generally tubular support made of electrically insulative material that at least partially surrounds the contact 1800 and more preferably completely surrounds contact 1800. The connector 1700 includes a clip 1802 mounted within the back end of the contact 1800 to contact the center conductor of the coaxial cable. The contact 1800 also has a clip 1802 mounted at the front end to make electrical contact with the male connector at the terminal. The guide 1718, the contact 1800 and the clips 1802 make up a contact assembly. The contact assembly is capable of moving longitudinally, as a unit, relative to the body 1714. A label 2003 is optionally affixed to the outer surface of the shell 1712.

Figure 26:
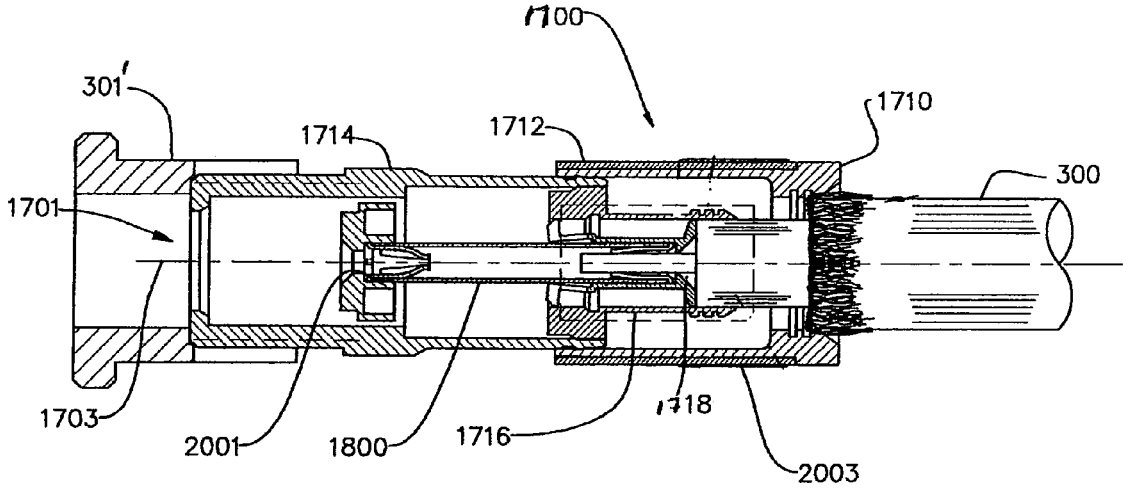
FIG. 26 is a cross-sectional view of the connector of FIG. 24 at a first stage of attachment of the coaxial cable.

FIG. 26 is a cross-sectional view of the connector 1700 and the cable 300 at a first stage of attachment. FIG. 9 shows the cable 300 partially inserted into connector 1700. A tip of the center conductor 431 of the cable 300 has entered the contact 1800. The dielectric layer 432 of the cable 300 pushes directly on the guide 1718 to push the contact assembly forward into body 1714. The front flanges of the guide 1718 have been deflected inward and out of the annular groove in the post 1716, allowing the guide 1718 to move forward. The insulator body 2001 also moves along with the contact 1800 toward the toward the front end 1701 of the connector 1700.

Figure 27:
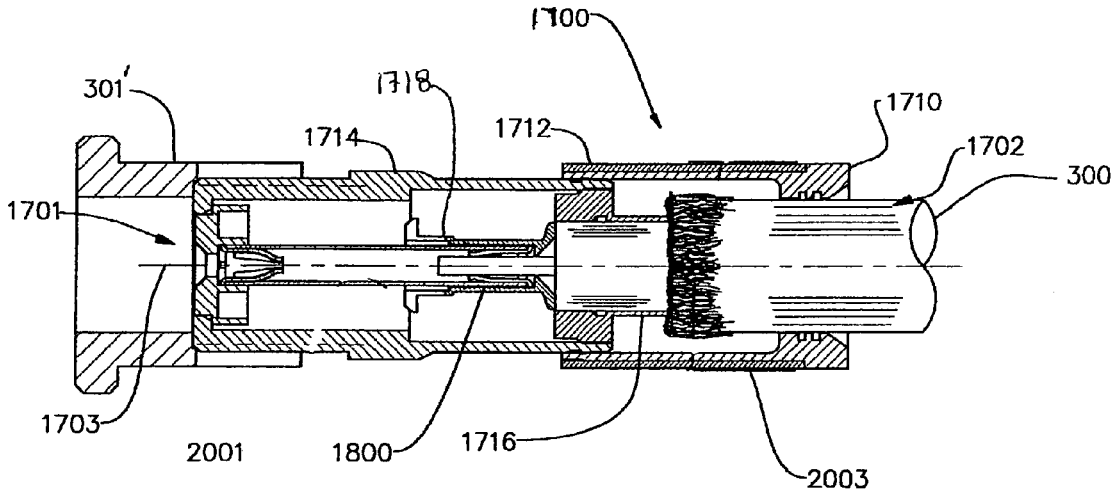
FIG. 27 is a cross-sectional view of the connector of FIG. 24 at a second stage of attachment of the coaxial cable.

FIG. 27 is a cross-sectional view of the connector 1700 showing a second stage of attachment with the cable 300 fully seated. In FIG. 27, the contact 1800 is in a final position, that is, the contact 1800 is in the appropriate position for mating with a male connector at the front end 1701. The final positioning of the contact 1800 is when the insulator body 2001 engages a rearward facing surface of body 1714 at the front end 1701 of connector 1700. An advantage of the connector 1700 is that proper seating of the cable 300 is indicated by the final position of the contact 1800 and insulator body 2001 as they provide visual confirmation of proper insertion of the cable 300.

Figure 28:
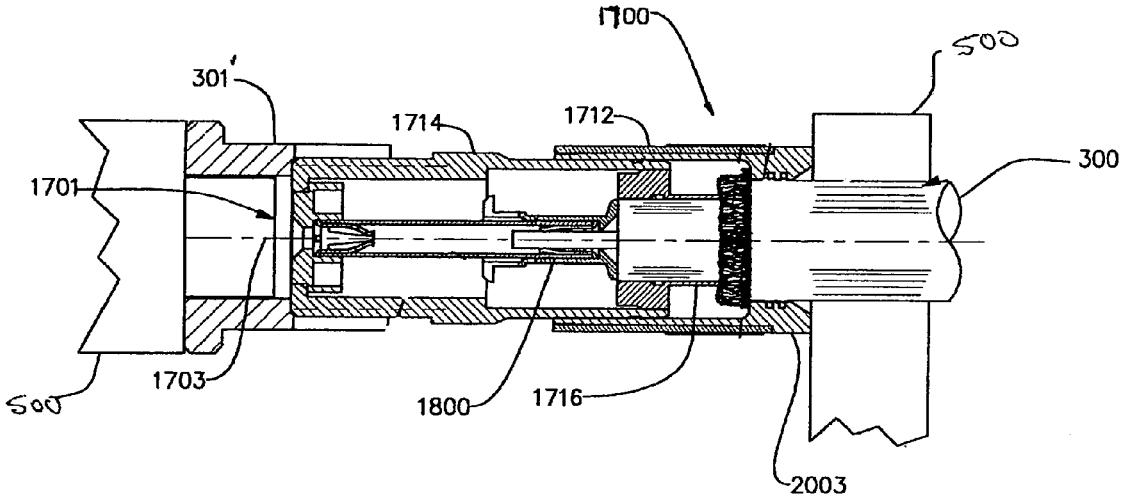
FIG. 28 is a cross-sectional view of the connector of FIG. 24 fully assembled and illustrating a portion of the compression tool engaging the connector and the adapter.

FIG. 28 is a cross-sectional view of the connector 1700 and the cable 300 assembled together with the contact 1800 remaining in its final position. Also illustrated in FIG. 28 is the adapter 301' engaged in one portion of a tool 500 and the connector 1700, as well as a second portion of the tool 500 engaging the back end 1702 of the connector 1700. After the tool 500 is activated, the compression ring 1710 is moved forward and into a closed position, engaging the outer conductor 433 and the jacket 434 of the cable 300 with the post 1716. The tool 500 and the adapter 301 are then removed and the connector 1700 is in an "in use" state.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A coaxial cable connector for attachment to a coaxial cable and for receiving an electrical contact, the coaxial cable comprising a center conductor, a dielectric layer surrounding the center conductor, and an outer conductor surrounding the dielectric layer, the coaxial cable connector comprising:

a body having a front end, a back end, and a longitudinal opening extending between the front end and the back end along a longitudinal axis;

a post fixedly mounted within the body; and a contact assembly movably mounted to the post and capable of moving longitudinally relative to the body, the contact assembly comprising:

a guide having an opening therein to receive the center conductor of the coaxial cable;

a contact element having a fixed relationship to the guide and having a front end, a back end, and an opening extending between the front end and the back end to receive the electrical contact through the front end of the body; and an insulator disposed around at least a portion of the contact element, wherein the contact assembly is capable of moving along the longitudinal axis toward the front end of the coaxial cable connector in response to insertion of the coaxial cable into the back end of the coaxial cable connector, wherein the front end of the contact element is disposed adjacent the front end of the body when the coaxial cable is fully inserted into the back end of the coaxial cable connector;

wherein the body further comprises a rearward facing surface configured to engage the insulator and limit longitudinal movement of the contact assembly.

2. The coaxial cable connector of claim 1, in which the connector is configured to allow the dielectric layer of the coaxial cable to contact the contact assembly to cause the contact assembly to move relative to the body.

3. The coaxial cable connector of claim 1, wherein the post has a circumferential groove in an inside surface of the post and the guide has a least one projection configured to engage the circumferential groove in a first position.

4. The coaxial cable connector of claim 3, wherein the at least one projection is mounted at a front end of the guide and is deflectable radially inward away from the circumferential groove.

5. The coaxial cable connector of claim 1, wherein the opening in the guide is viewable to a user until the center conductor of the coaxial cable enters the opening.

6. The coaxial cable connector of claim 1, wherein a back end of the guide has a funnel-shaped configuration with an opening aligned with the longitudinal axis for receiving the center conductor of the coaxial cable, such that the dielectric layer and not the center conductor of the coaxial cable contacts and moves the contact assembly.

7. The coaxial cable connector of claim 1, wherein the electrical contact is a male conductor of a connector from group that includes BNC, RCA, and F-type connectors.

8. The coaxial cable connector of claim 1, further comprising a compression ring having an inside surface defining a longitudinal opening, the compression ring movable over at least a portion of the body to engage at least a portion of an outer jacket of the coaxial cable.

9. The coaxial cable connector of claim 1, wherein the insulator is capable of limiting longitudinal movement of the contact assembly relative to the body.

10. A combination of an adapter for a coaxial cable connector and coaxial cable connector for coupling an end of a coaxial cable to a terminal comprising:

a body having a front end, a back end, a longitudinal opening extending between the front end and the back end along a longitudinal axis;

a post fixedly mounted within the body and having a circumferential groove in an inside surface thereof; and a contact assembly movably mounted to the post and capable of moving longitudinally relative to the body, the contact assembly comprising:

a guide having an opening therein to receive the center conductor of the coaxial cable; and a contact element having a fixed relationship to the guide; and an adapter configured to be disposed on the front end of the coaxial cable connector body, the adapter comprising:

a main body having a first end, a second end, and an interior surface defining an opening therethrough between the first end and the second end, the opening configured to pass over the front end of the coaxial cable connector;

a forward facing surface configured to engage a portion of the body of the coaxial cable connector; and a rearward facing surface at the first end configured to engage a tool to compress the coaxial cable connector.

11. A method of assembling a coaxial cable connector, comprising the steps of:

providing a coaxial cable connector having a body with a front end, a back end, a hexagonal portion, and a longitudinal opening extending between the front end and the back end along a longitudinal axis, inserting a post into the body from the back end of the body;

inserting a contact assembly into the post so that the contact assembly is capable of moving longitudinally relative to the body;

inserting a coaxial cable into the contact assembly of the coaxial cable connector;

disposing an adapter over the front of the body of the coaxial connector; and axially compressing the adapter and the connector relative to one another thereby axially compressing the coaxial cable connector to secure the coaxial cable in the coaxial cable connector.

12. The method of assembling a coaxial cable connector according to claim 11, wherein a dielectric layer of the coaxial cable moves the contact assembly longitudinally forward relative to the body in the step of inserting the coaxial cable.

13. The method of assembling a coaxial cable connector according to claim 11, further comprising the step of inserting a male electrical conductor into the front end of the body to make physical and electrical contact with the contact assembly.

* * * * *